US006793023B2

(12) United States Patent
Holzer et al.

(10) Patent No.: US 6,793,023 B2
(45) Date of Patent: Sep. 21, 2004

(54) HAND POWER TOOL

(75) Inventors: Peter Holzer, Solothurn (CH); Robert Simm, Oekingen (CH)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/343,366

(22) PCT Filed: May 29, 2001

(86) PCT No.: PCT/DE01/02035

§ 371 (c)(1),
(2), (4) Date: Jan. 30, 2003

(87) PCT Pub. No.: WO02/11933

PCT Pub. Date: Feb. 14, 2002

(65) Prior Publication Data

US 2003/0173097 A1 Sep. 18, 2003

(30) Foreign Application Priority Data

Aug. 3, 2000 (DE) ..... 100 37 808

(51) Int. Cl.[7] ..... B25D 9/00
(52) U.S. Cl. ..... 173/178; 173/48; 173/104
(58) Field of Search ..... 173/104, 109, 173/201, 48, 178

(56) References Cited

U.S. PATENT DOCUMENTS 4,400,995 A * 8/1983 Palm ..... 74/527
4,967,888 A * 11/1990 Lippacher et al. ..... 192/56.5
5,372,206 A * 12/1994 Sasaki et al. ..... 173/178
5,379,848 A * 1/1995 Rauser ..... 173/48
5,588,496 A * 12/1996 Elger ..... 173/178
6,035,945 A * 3/2000 Ichijyou et al. ..... 173/48
6,550,546 B2 * 4/2003 Thurler et al. ..... 173/48

FOREIGN PATENT DOCUMENTS

| | | |
|---|---|---|
| DE | 25 22 446 A | 12/1976 |
| DE | 193 03 454 A | 8/1999 |
| EP | 0 566 926 A | 10/1993 |

* cited by examiner

*Primary Examiner*—Scott A. Smith
(74) *Attorney, Agent, or Firm*—Michael J. Striker

(57) ABSTRACT

The invention is based on a hand power tool having a tool mount capable of being driving in an at least rotating fashion via a drive motor and a drilling spindle (13), which said tool mount comprises a clamping device for securing tools that is capable of being operated in the direction of rotation of the drilling spindle (13), and having an arresting mechanism (38), via which the drilling spindle (13) can be coupled in torsion-resistant fashion relative to a part (27) of the machine housing (26) to tighten and loosen the clamping device of the tool mount (12), and which opens automatically when torque is transferred from the drive motor to the tool mount (12) and locks automatically when torque is transferred from the tool mount (12) to the drive motor. The arresting mechanism (38) is located on an intermediate shaft (17) and combined with a safety clutch (58) that is also located on the intermediate shaft (17) (FIG. 2).

19 Claims, 2 Drawing Sheets

HAND POWER TOOL

BACKGROUND OF THE INVENTION

The invention is based on a hand power tool.

A hand power tool of this type is known (DE 198 03 454 A1). A drilling spindle capable of being driven by the drive motor is capable of being stopped in torsion-resistant fashion relative to the housing of the hand power tool by means of the arresting mechanism, so that a tool mount, e.g., a drilling chuck, screwed together with the drilling spindle can be loosened from the drilling spindle and/or a tool can be clamped in the tool mount in keyless fashion. The arresting mechanism is located on an intermediate shaft that is capable of being coupled with the drilling spindle via two gear stages. The arresting mechanism opens automatically when torque is transferred from the drive motor in the direction toward the tool mount, and it locks automatically when torque is transferred from the tool mount toward the drive motor.

SUMMARY OF THE INVENTION

The hand power tool according to the invention has the advantage that a safeguard against overload-into the torm of the safety clutch that operates in the torque-dependent fashion-for the operator is created if the drilling spindle suddenly lams, e.g., if the drill bit becomes stuck. In addition, a safeguard against overload is therefore obtained that protects the gear mechanism and/or the arresting mechanism against overload. Since the safety clutch is incorporated in the arresting mechanism, practically no additional expense is required for the safety clutch. Nor is any additional installation space required in the machine housing, nor does the machine housing have to be specially adapted for the installation space required therefore. As a further result of the integration, as few components as possible are required for the arresting mechanism and the safety clutch. Overall, despite the addition of the safety clutch, practically no additional assembly expense or costs are required.

Further details and advantages of the invention result from the subsequent description of the drawing and the drawings in which an exemplary embodiment of the invention is presented. The drawings, the description, and the claims contain numerous features in combination. One skilled in the art will advantageously consider them individually as well and combine them into reasonable further combinations.

DESCRIPTION OF THE PREFERRED EMBODIMENTS

Figure 1:
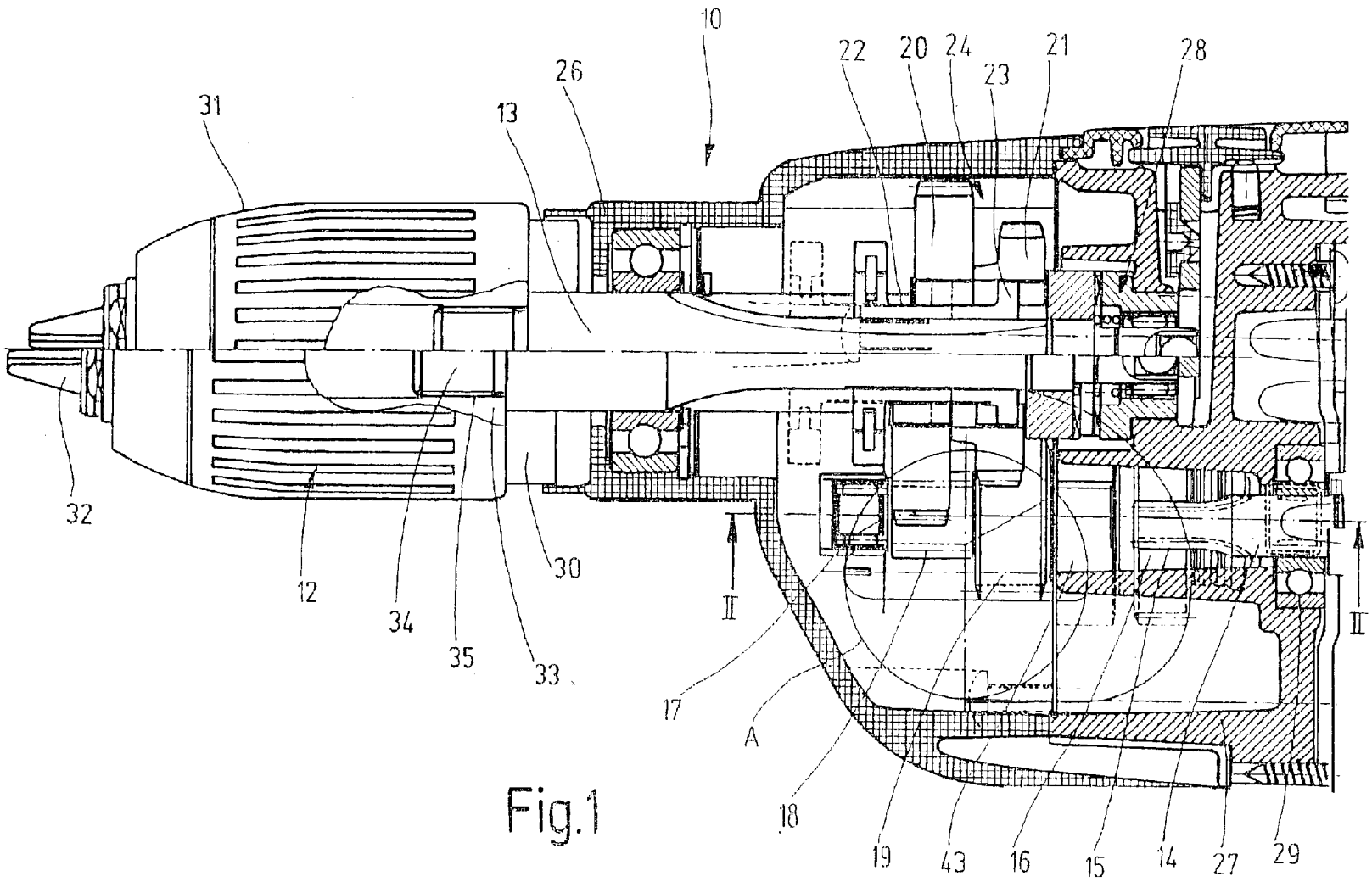
FIG. 1 shows a longitudinal sectional drawing with a partial side view of an impact drill.

FIG. 1 shows a schematic diagram of a hand power tool in the form of an impact drill 10 having a (not further shown) drive motor located in a machine housing 26 to drive a tool mount 12 in an at least rotating fashion. The drive motor comprises a motor shaft 14, the end of which is equipped with a drive pinion 15 or a similar toothing, and which is turnably supported in a flange 27 by means of a bearing 29;

e.g., a roller bearing. The flange 27 is a separate component and is permanently joined with the machine housing 26. The drive motor has a transmission connection via the motor shaft 14 with a drilling spindle 13 with which the tool mount 12 is joined in detachable fashion, e.g., they are screwed together via threads 35.

Figure 2:
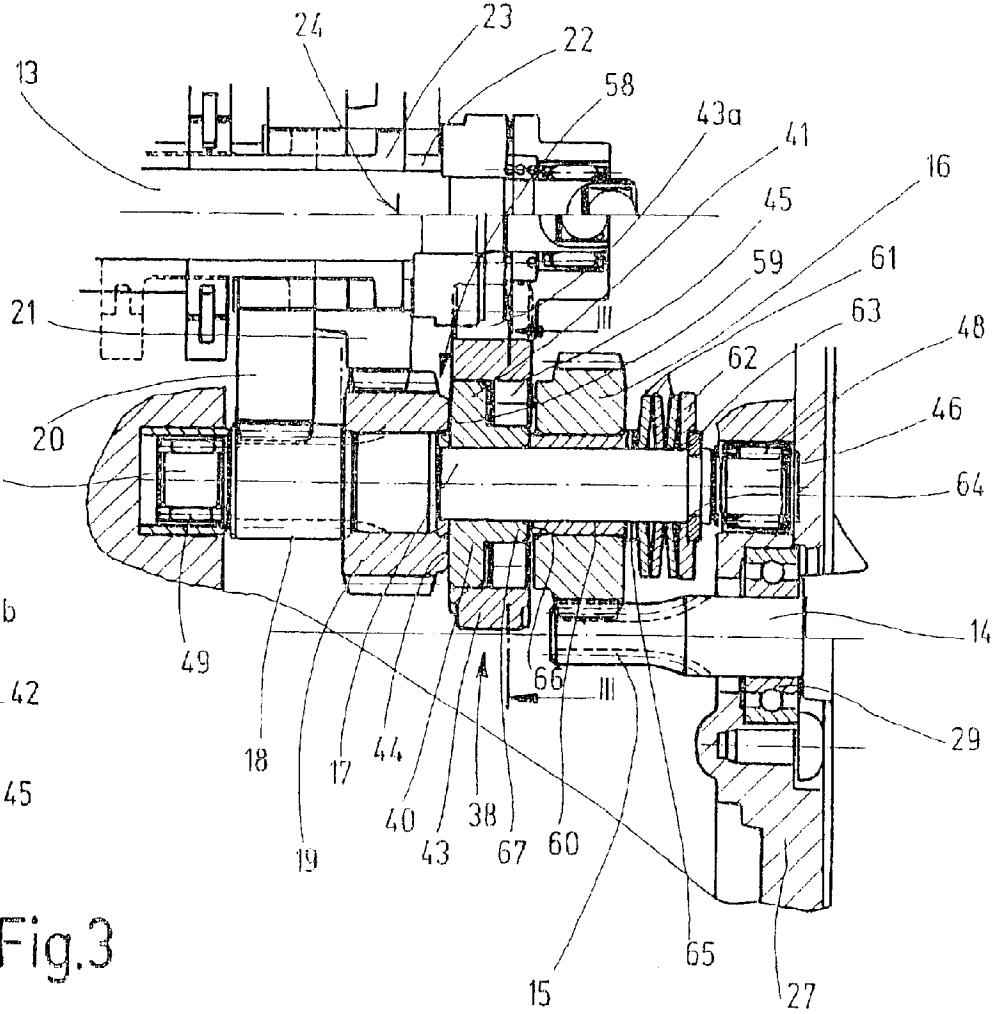
FIG. 2 shows a sectional drawing along the line II—II of Detail A in FIG. 1.

The drive pinion 15 meshes with a gear 16 shown in FIG. 2 that is coaxial with the intermediate shaft 17 and is turnable relative to the intermediate shaft 17. The intermediate shaft 17 is turnably supported in the flange 27 with a journal 46 located on the end by means of a needle-roller bearing 48. The other journal 47 is turnably supported in the machine housing 26 by means of a needle-roller bearing 49. The intermediate shaft 17 has toothing 18 and, next to that, a gear 19 joined therewith in torsion-resistant fashion, e.g., said gear is pressed on hot, which said toothing and gear mesh with gear wheels 20 and 21 that are turnably supported on the drilling spindle 13 and, alternatively, they are capable of being converted into a torque-transferring state with the drilling spindle 13, e.g., by means of a sliding key 23 capable of being displaced axially in a longitudinal groove 22 of the drilling spindle 13. The sliding key 23, together with the gear wheels 20, 21 and a not-further-shown operating device, form a speed-changing mechanism 24 having two gears. A first gear (slow rotational speed) is formed by the gear pair 18, 20, and a second gear (fast rotational speed) is formed by the gear pair 19, 21. The transmission ratio of these gear stages 18, 20 and 19, 21 is negative, i.e., speed reduction takes place from the intermediate shaft 17 to the drilling spindle 13.

A notched impact mechanism 28 housed in the flange 27 sits on an end of the drilling spindle 13 furthest away from the tool mount 12, via which said notched impact mechanism axial blows can be applied to the drilling spindle 13. The notched impact mechanism 28 can be switched off in the usual fashion, so that the impact drill 10 can also be used as a drill having two speeds.

The tool mount 12 is designed as a jaw chuck, for example, that comprises chuck jaws 32 capable of being adjusted by means of a sleeve 21 and a cone nut joined therewith in torsion-resistant fashion, between which said chuck jaws the shaft of a tool can be clamped. A main body 33 of the tool mount 12 is screwed—via the thread 35—onto a threaded journal 34 of the drilling spindle 13 with high preload, so that the tool mount 12 and the drilling spindle 13 are interconnected in torsion-resistant fashion when the machine is used as an impact drill 10. A dust collar 30 of the sleeve 31 extends into an opening of the machine housing 26.

When the tool is replaced, the drilling spindle 13 absorbs loosening or tightening torque and is capable of being coupled in torsion-resistant fashion relative to the flange 27 of the machine housing 26 by means of an arresting mechanism 38. The arresting mechanism 38 is located between the drilling spindle 13 and a part of the machine housing 26 on the intermediate shaft 17. A nearly annular housing 43 that is held by means of radial projections 43*a* in non-turnable and positive fashion in a part of the flange 27 is a component of the arresting mechanism 38. The housing 43 has a cylindrical hole 53 that is coaxial with the intermediate shaft 17. Located in said hole is a disk 40 comprising radially projecting driving elements 41, which said disk is located on the intermediate shaft 17 in such a fashion that it is turnable relative to said intermediate shaft and is at least slightly displaceable in the axial direction. The arresting mechanism 38 also includes the gear 16 that is turnable relative to the intermediate shaft 17 and that is capable of being driven by the drive motor via the drive pinion 15, which said gear comprises—on the end face closest to the disk 40—nearly claw-like projections 39*a*, 39*b* extending nearly parallel with each other toward the disk 40. These projections 39*a*, 39*b* can have the form of cylindrical pins that fit into the annular space and can orbti in said annular space, which said annular space is formed between the hole 53 and an outer circumferential surface 54 of the disk 40 that extends between the two diametrically opposed driving elements 41. The driving elements 41 are shaped in such a fashion that the disk 40 is capable of being rotated with limitations between adjacent claws 39*a*, 39*b*. The outer circumferential surface 54 of the disk 40 has a cylindrical basic shape, whereby this cylindrical basic shape transitions into a flat spot 42 approximately in the center between two adjacent driving elements 41. Only a small amount of motional play exists in the region of the external surface of the driving elements 41 between said driving elements and the hole 53 in the housing 43. Adjacent to this, in the region of the cylindrical circumferential surface 54 of the disk 40, a radial clearance is provided between the disk 40 and the hole 53 that is just large enough to accommodate the projections 39*a*, 39*b* with slight motional play. A larger radial clearance exists in the region of each flat spot 42 between the hole 53 and the flat spot 42. Accommodated in each of these regions is a cylindrical rolling element 45 having a small amount of motional play, the diameter of which exceeds the radial thickness of the nearly claw-shaped projections 39*a*, 39*b*. The rolling elements 45 are wedging rollers. The claw-like projections 39*a*, 39*b* can have different lengths in the circumferential direction, for example, whereby diagonally opposed pairs 39*a* on one side and 39*b* on the other can each have the same length. Instead of this, the projections 39*a*, 39*b* can also be equal in size.

Figure 3:
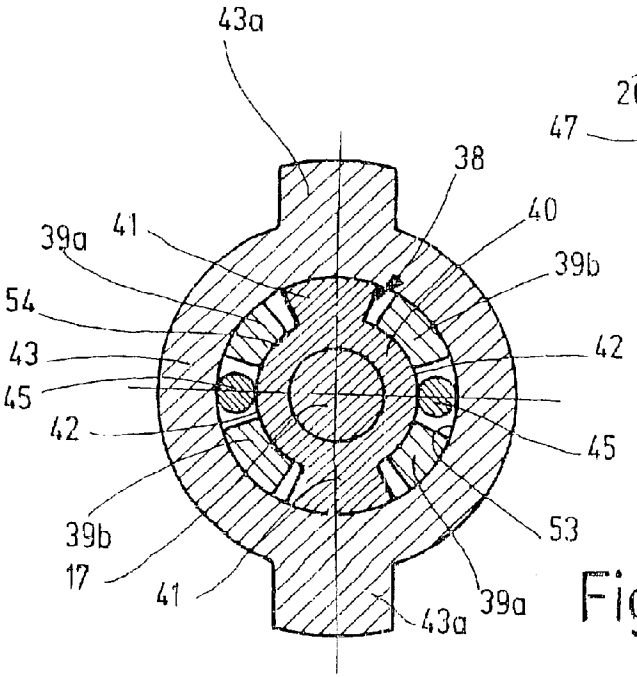
FIG. 3 shows a sectional drawing along the line III—III in FIG. 2.

When torque is transferred from the drive motor via the motor shaft 14 with drive pinion 15 to the gear 16, the projections 39*a* act on the driving elements 41 in torque-transferring fashion, whereby the rolling elements 45—due to their inertia—come to be situated in front of the claws 39*b* adjacent to them. The adjacent claws 39*b* then hold the rolling elements 45 in the region of the respective flat spots 42, ensuring an uninhibited transfer of torque, in the clockwise direction in this example and in the illustration according to FIG. 3. It is understood that, when the gear 16 is driven in the opposite direction and the claw-like projections 39*a*, 39*b* orbit in the opposite direction, the projections 39*b* act on the driving elements 41 in torque-transferring fashion, and the other claws 39*a* then act on the rolling elements 45 in such a fashion that they remain in the region of the flat spots 42, and an uninhibited transfer of torque in the other direction of rotation is ensured.

On the other hand, when a transfer of torque is not initiated via the motor shaft 14, but via the drilling spindle 13 and it starts from the tool mount 12, each of the driving elements 41 acts on the projections 39*a, b* in torque-transferring fashion. Due to their inertia, the rolling elements 45 are then forced in the direction toward the torque-transferring projections 39*a, b*, whereby they become clamped between the flat spots 42 of the disk 40 and the hole 53 of the housing 43. As a result, the disk 40 is automatically immobilized in the housing. As a result, it is then possible to apply counter-torque to the drilling spindle 13 when tightening or loosening a tool in the tool mount 12, or when screwing the tool mount 12 onto or off of the drilling spindle 13, and to do so without requiring any type of special, manually-operated locking device.

A safety clutch 58 that is also located on the intermediate shaft 17 is incorporated in the heretofore-described arresting mechanism 38. The safety clutch 58 is designed, e.g., as a slip clutch or tooth clutch having radial teeth. It is located axially on the driven side of the arresting mechanism 38. It offers a safeguard against overload for the operator, as well as for the arresting mechanism 38 and the described gear mechanism, it is extraordinarily simple, and requires only a small amount of installation space. Since the safety clutch 58 is integrated in the arresting mechanism 38, the number of components is also reduced. Assembly expense is reduced as well.

Details of the safety clutch 58—including further details of the arresting mechanism 38 having a transmission connection therewith—are described hereinbelow. The safety clutch 58 is developed between the disk 40 having the radial driving elements 41 and a stopping face 59 affixed to the intermediate shaft, which said stopping face is formed here by the axial end surface of a gear 19 of one gear stage, which said gear is situated on the intermediate shaft 17 in torsion-resistant fashion. The disk 40 can be pressed axially—with its closest end face 44—against this stopping face 59 by means of spring-acting axial force bearing against the intermediate shaft 17. A cylindrical sleeve 60 capable of being turned relative to the intermediate shaft 17 and that extends on the side of the disk 40 furthest away from the stopping face 59 is seated on said intermediate shaft. The sleeve 60 bears axially against the disk 40 with its end closest to the disk 40 and, there, is pressed against said disk. The spring-acting axial force acts on the other end of the sleeve 60 that is furthest away from the disk 40. For this purpose, at least one spring 61—in particular a disk spring—producing the axial force is located on the intermediate shaft 17. A plurality of disk springs 61 is provided with the exemplary embodiment shown. They are seated directly on the intermediate shaft 17. On the right side as shown in FIG. 2, the disk springs 61 are supported axially in relation to the intermediate shaft 17 by means of a locking washer 62 and a captive-lock washer 63. The captive-lock washer 63 is accommodated with positive engagement in a groove 64 in the intermediate shaft 17. Shims 65 are located between the disk springs 61 and the closest end face of the sleeve 60. Due to the arrangement described, the at least one spring—in the form of a disk spring 61 in this case—is supported axially on the intermediate shaft 17 on the one hand and, on the other, it acts on the closest end of the sleeve 60 with spring force. The sleeve 60 is therefore acted on axially with spring force toward the left as shown in FIG. 2. With the end that is furthest away from the disk 40 and, therefore, is closest to the at least one spring 61, the sleeve 60 extends axially beyond the right (as shown in FIG. 2) end face of the gear 16. The gear 16 is turnably supported on the sleeve 60. The left (as shown in FIG. 2) end of the sleeve 60 also extends beyond that end face of the gear 16, whereby the sleeve 60—with this end face—is pressed axially against the closest end face 66 of the disk 40. As a result, the disk 40—which is turnable on the intermediate shaft 17 and capable of being axially displaced at least slightly—is pressed with its end face 44 against the closest stopping face 59 of the gear 19, so that, in this fashion, the disk 40 is joined in torque-transferring fashion with the gear 19 and via this with the intermediate shaft 17.

The disk 40 has a hub 67 that—as shown in FIG. 2 right—extends to the closest end face of the sleeve 60 and has the end face 66 acted upon by the sleeve 60.

The stopping face 59—affixed to the intermediate shaft—of the gear 19 joined with the intermediate shaft 17 in torsion-resistant fashion, on the one hand, and the end face 44 of the disk 40 closest to this, on the other, can have surface areas, e.g., rubbing surfaces, forming frictional contact on the end faces facing each other and pressed against each other with spring action by means of the at least one spring 61. Instead of this, these surfaces 59 and 44 can also have raised areas and recesses—in particular radial teeth integral therewith—that bring about positive engagement. In the exemplary embodiment shown, the safety clutch 58 is designed as a positive coupling of the type with which the surfaces 44 and 59 contacting each other have integral radial teeth (not shown). The gear 19 is produced completely in simple fashion as a sintered part in that the radial teeth are formed as parts of the safety clutch 58 during production; this results in considerable cost savings. Moreover, the complete disk 40, including its driving elements 41, and the hub 67 integral therewith and the radial teeth on the end face 44 is also advantageously designed as a sintered part, so that costs for this are minimized as well. The sleeve 60, as a further part of the safety clutch 58, is a simple, cost-effective component that requires no additional installation space. The safety clutch 58 offers a safeguard against overload for the operator as well as for the arresting mechanism 38 and the gear mechanism. It is integrated, in cost-saving fashion, in the arresting mechanism 38, which is also designed in cost-effective fashion as a result, without the arrangement of the safety clutch 58 requiring more installation space. Since the number of components is reduced, the assembly expense is reduced as well.

It is obvious that the safety clutch 58 is located axially next to the arresting mechanism 38 and on the driven side of said arresting mechanism, which is specified by the disk 40, and, therefore, with axial clearance from the arresting mechanism 38.

When the driving force is transferred from the motor shaft 14 via the gear 16 and its claw-like projections 39*a*, b to the driving elements 41, the disk 40 is driven, whereby, when the safety clutch 58 is operative, the drive torque is transferred from the disk 40 to the gear 19 and, therefore, to the intermediate shaft 17. If the drive torque exceeds the permissible momentum of the safety clutch 58, the safety clutch 58 responds in such a fashion that the disk 40 is pressed axially against the force of the at least one spring 61—to the right as shown in FIG. 2—and the driving force between the disk 40 and the gear 19 is therefore disengaged. As a result, the operator is protected against excessive reaction torque of the machine, and potential damage to or destruction of the arresting mechanism 38 is prevented.

If the driving force takes place in the opposite direction from the tool mount 12 and the drilling spindle 13 toward the intermediate shaft 17, this momentum is absorbed by the disk 40 when the safety clutch 59 is engaged, since, in this case, the arresting mechanism 38 blocks the disk 40 by clamping the rolling elements 45 between the hole 53 in the housing 43 and the flat spots 42 on the disk 40. In terms of its transferrable momentum, the safety clutch 58 is adjusted in such a fashion that, in this state of being clamped by the rolling elements 45, the safety clutch 58 does not yet respond in terms of decoupling, since the momentum introduced into the drilling spindle 13—e.g., to replace the tool or to loosen the tool mount 12—is less than the permissible transferrable momentum of the safety clutch 58. Only when a comparably impermissible, higher momentum is introduced via the drilling spindle 13 can the safety clutch 58 respond in terms of decoupling, in order to prevent damage to or destruction of the arresting mechanism 38 and the gear mechanism.

What is claimed is:

1. A hand power tool selected from the group consisting of drill and an impact drill, comprising a machine housing; a drilling spindle; a drive motor for driving said drilling spindle in at least rotating fashion; a tool mount, said drilling spindle absorbing loosening or tightening torque when a tool is replaced and is coupleable in torsion-resistant fashion to a part of said machine housing; an arresting mechanism for coupling said drilling spindle to said part of said machine housing, said arresting mechanism being located between said drilling spindle and said part of said machine housing; an intermediate shaft on which said arresting mechanism is located and which is joined in turnable fashion with said drilling spindle, said intermediate shaft being coupleable with said drilling spindle; at least one gear stage coupling said intermediate shaft with said drilling spindle and opening automatically when torque is transferred from said drive motor to said tool mount and locking automatically when the torque is transferred from said tool mount in an opposite direction; and a safety clutch incorporated in said arresting mechanism and located on said intermediate shaft.

2. A hand power tool as defined in claim 1, wherein said safety clutch is located axially on a driven side of said arresting mechanism.

3. A hand power toot as defined in claim 1, wherein said safety clutch is located between a disc of said arresting mechanism having radially protruding driving elements and a stopping face affixed to said intermediate shaft, against which said disc is pressable axially by a spring-acting axial force bearing against said intermediate shaft.

4. A hand power tool as defined in claim 3, wherein said disc is located on said intermediate shaft so that it is rotatable relative to said intermediate shaft and displaceable at least slightly in an axial direction by a hub which is integral therewith.

5. A hand power tool as defined in claim 3; and further comprising a sleeve located on said Intermediate shaft and extending on a side of said disc farthest away from said stopping face affixed to said intermediate shaft.

6. A hand power tool as defined in claim 5, wherein said sleeve has an end face which is closest to said disc and bears axially against said disc.

7. A hand power tool as defined in claim 6, wherein said sleeve is arranged so that an axial force acts on another end of said sleeve farthest away from said disc.

8. A hand power tool as defined in claim 3; and further comprising at least one spring producing said axial force and located on said intermediate shaft.

9. A hand power tool as defined in claim 8, wherein said spring is a disc spring.

10. A hand power tool as defined in claim 8, wherein said at least one spring bears axially against said intermediate shaft and acts on a closest side of said sleeve with spring action.

11. A hand power tool as defined in claim 1; and further comprising a gear driveable by said drive motor and situated in a turnable fashion on said intermediate shaft, said gear having projections extending essentially parallel to each other and towards a disc on an end face closest to said disc as a part of said arresting mechanism.

12. A hand power tool as defined in claim 11, wherein said gear is located on a sleeve which is located on said intermediate shaft.

13. A hand power tool as defined in claim 12, wherein said sleeve extends axially beyond said gear with an end farthest away from said disc.

14. A hand power tool as defined in claim 13, wherein said stopping face affixed to said intermediate shaft is formed by an axial surface of a gear of a gear stage, laid gear being situated on said intermediate shaft in torsion-resistant fashion.

15. A hand power tool as defined in claim 14, wherein said gear is pressed onto said intermediate shaft.

16. A hand power tool as defined in claim 14, wherein said stopping face affixed to said intermediate shaft, and said gear and said disc, comprise areas having contact with each other and forming a connection selected from the group consisting of a frictional connection and a positive connection on end faces facing each other and pressed against each other.

17. A hand power tool as defined in claim 16, wherein said end faces are provided with raised areas and with recesses, formed as radial teeth.

18. A hand power tool as defined in claim 11, wherein said arresting mechanisms has a housing held in said part of said machine housing, said gear having projections and said disc having radial driving elements separated at a circumference by angles; and rolling elements each formed as a wedging roller being arranged between two of said projections extending in a circumferential direction between two of said driving elements, so that when torque is transferred from said drive motor in a direction of said tool mount, said projections release said rolling elements so that they orbit in said housing, and when torque is transferred from said tool mount in a direction of said drive motor, said driving elements jam said rolling elements against said housing.

19. A hand power tool as defined in claim 3, wherein at least one element selected from the group consisting of a disc comprising driving elements and an end face of safety clutch, a gear affixed to said intermediate shaft and having a stopping face, and both is formed as a sintered part.

* * * * *